US005699791A

United States Patent [19]

Sukiennik et al.

[11] Patent Number: 5,699,791

[45] Date of Patent: Dec. 23, 1997

[54] UNIVERSAL FIT FACE MASK

[75] Inventors: Corrine A. Sukiennik, Alpharetta; Michael P. Mathis; Vivian Gray, both of Marietta, all of Ga.

[73] Assignee: Kimberley Clark Corporation, Roswell, Ga.

[21] Appl. No.: 658,237

[22] Filed: Jun. 4, 1996

[51] Int. Cl.[6] ..... A62B 7/10

[52] U.S. Cl. ..... 128/206.13; 128/206.19

[58] Field of Search ..... 128/200.26, 206.12, 128/206.13, 206.19, 206.21, 206.28, 205.29, 207.11, 207.17

[56] References Cited

U.S. PATENT DOCUMENTS

| | | | |
|---|---|---|---|
| 2,868,196 | 1/1959 | Stampe | 128/207.11 |
| 3,082,767 | 3/1963 | Matheson | 128/207.11 |
| 3,276,944 | 10/1966 | Levy . | |
| 3,308,816 | 3/1967 | Franklin et al. | 128/207.11 |
| 3,338,992 | 8/1967 | Kinney . | |
| 3,341,394 | 9/1967 | Kinney . | |
| 3,502,538 | 3/1970 | Petersen . | |
| 3,502,763 | 3/1970 | Hartmann . | |
| 3,542,615 | 11/1970 | Dobo et al. . | |
| 3,692,618 | 9/1972 | Dorschner et al. . | |
| 3,849,241 | 11/1974 | Butin et al. . | |
| 3,985,132 | 10/1976 | Boyce et al. | 128/206.19 |
| 4,340,563 | 7/1982 | Appel et al. . | |
| 4,417,575 | 11/1983 | Hilton et al. | 128/206.16 |
| 4,419,994 | 12/1983 | Hilton | 128/206.16 |
| 4,635,628 | 1/1987 | Hubbard et al. | 128/201.17 |
| 4,662,005 | 5/1987 | Grier-Idris | 128/206.19 |
| 4,688,566 | 8/1987 | Boyce | 128/206.19 |
| 4,720,415 | 1/1988 | Vander Wielen et al. . | |
| 4,807,619 | 2/1989 | Dyrud et al. | 128/206.16 |
| 4,941,479 | 7/1990 | Hubbard et al. | 128/206.13 |
| 5,169,706 | 12/1992 | Collier, IV et al. . | |
| 5,213,881 | 5/1993 | Timmons et al. . | |
| 5,226,992 | 7/1993 | Morman . | |
| 5,401,446 | 3/1995 | Tasi et al. . | |

FOREIGN PATENT DOCUMENTS

| | | |
|---|---|---|
| 803714 | 1/1969 | Canada . |

OTHER PUBLICATIONS

"Manufacture of Superfine Organic Fibers", by V. A. Wente et al., Navy Research Laboratory, Washington, D.C., NRL Report 4364 (111437), May 25, 1994, US Dept. of Commerce, Office of Technical Services.

"An Improved Device for the Formation of Superfine, Thermoplastic Fibers", by Lawrence et al., NRL Report 5265, Feb. 11, 1959, US Dept. of Commerce, National Technical Information Service.

*Flex Shield*; Author: Splash Shield, Mar. 1996 (one double-sided brochure).

ProCare, Inc., Apr. 1, 1997; Top view and bottom view photographs of surgical mask.

*Primary Examiner*—Vincent Millin
*Assistant Examiner*—Robert N. Wieland
*Attorney, Agent, or Firm*—Hardaway Law Firm, P.A.

[57] ABSTRACT

A conformable face mask for health care workers is provided. The use of elastomeric materials applied under tension helps define a plurality of gathers which facilitate the donning and positioning of the mask. An elastomeric headband maintains a comfortable and efficient seal while a similar elastomeric chin strap helps provides a pouch-like enclosure for the wearer's chin. The substantially rectangular face mask includes a plurality of horizontal stays which are individually adjustable to create a three dimensional shaped mask which defines a spaced breathing area around the wearer's nose and mouth. Additional rigidity is provided by the selected melting of horizontal bands of the filter portion of the mask.

18 Claims, 5 Drawing Sheets

UNIVERSAL FIT FACE MASK

BACKGROUND OF THE INVENTION

1. Field of the Invention

The present invention relates to a face mask and more particularly to a face-conforming mask.

2. Background Art

Face masks such as surgical masks used by health care providers serve multiple purposes. One, the masks are expected to filter exhaled air to limit bacterial release from the wearer into the immediate environment. Secondly, the mask should filter inhaled air to offer protection to the wearer from airborne contagions. This feature is increasingly important for health care providers who work with active tubercular patients as well as for surgical teams who utilize operating procedures which result in a volatilization or vaporization of tissues or body fluids. Thirdly, the mask should provide a barrier layer against bodily fluids or liquids which may harbor pathogens. Therefore, a tight sealing mask is required. Additionally, a useful mask should have good vapor release properties, minimize problems of mask "blow-by," and offer a comfortable fit and ease of donning and adjustment.

Traditional masks with manual tie straps are often installed too loose and are thereby ineffective. Further, the tie strap position may slip or change once the mask is installed, again compromising an effective seal.

It is known in the art to provide a face mask having some of the above useful properties. U.S. Pat. No. 4,662,005 discloses a face mask having a face conforming feature and which provides a seal between the wearer's face and the periphery of the mask. Overhead ties are used to secure the mask while bottom and side edges of the mask have elastic threads which helps provide a pouch-like configuration to the mask. However, there remains room for improvement and variation within the art of face masks.

OBJECTS OF THE INVENTION

The present invention uses a combination of features to provide a novel mask which conforms and adjusts to the wearer's face while maintaining an efficient, sealed fit. A fiber-based elastomeric headband, in conjunction with a tensioned chin strap, side gathers, and integral supports, provides a mask having an improved fit and increased comfort while maintaining the mask under proper tension and position relative to the wearer's face.

An important aspect of the present invention is the ability of a substantially flat mask to assume a contoured, 3-dimensional shape in conformity to an individual wearer's face. When the mask is initially donned, the wearer can adjust the terminal ends of each stay so as to position the mask periphery close to the wearer's face. If desired, a skin adhesive can be applied to an inner periphery of the mask, thereby improving its sealing properties on the user's face.

One aspect of the present invention was the realization that improper installation of a surgical type mask is a wide-spread and recurring problem. Accordingly, the ability to supply a user-adjustable face mask, in which the mask is individually fitted to the user's face, addresses a vital need within the health care industry. No matter how effective a bacterial barrier the constituent components of a mask may provide, if the mask is installed improperly or is improperly adjusted during use, the mask effectiveness is compromised.

It is therefore an object of the present invention to provide a face mask which offers an improved seal about the wearer's face.

It is a further and more particular object of the invention to provide a mask which reduces the problem of mask "blow-by" so that all exhaled air is passed through the filtering medium of the mask.

It is still a further and more particular object of this invention to provide a mask having a better defined breathing area which is less subject to collapse.

It is further and more particular object of this invention to provide a mask which can be donned more quickly and easily than conventional masks.

It is still a further and more particular object of this invention to provide a mask which provides an improved seal around the mask periphery adjacent to the wearer's face.

It is still a further and more particular object of this invention to provide a face mask having a substantially flat and rectangular shipping profile which can be subsequently adjusted to form a 3-dimensional structure in conformity to an individual wearer's face.

These as well as other objects of this invention are provided by a flexible face mask comprising: a generally rectangular filtration pad having an inner layer and outer layer, the pad having a top edge, a bottom edge and a pair of opposing side edges, the bottom edge being folded to define a pocket between opposing portions of the inner-layer; a fibrous elastomeric strap for retaining the mask on the head of the wearer; a first malleable stay integral with the upper-sealed edge; a second malleable stay secured along the bottom fold of the pad; a third malleable stay secured by the pad at a spaced distance from the first stay so as to be opposite the mouth and nose area of a wearer when the mask is donned; an elastomeric strip carried by a terminal flap of the pouch and being in further communication at either terminus of the strip with a corresponding side edge of the pad; wherein when the mask is donned, the plurality of stays are adjustable by the wearer to position a periphery of the mask in close conformity to the wearer's face while further defining a cup-like chamber opposite the nose and mouth of the wearer.

DETAILED DESCRIPTION

The present invention is directed towards a face mask having an improved fit. The improvement provides a mask which is easier to don and remove, is more comfortable to wear, is adjustable to conform to an individual's face, provides a more effective seal against the wearer's face, and which maintains the seal over time.

Figure 1:
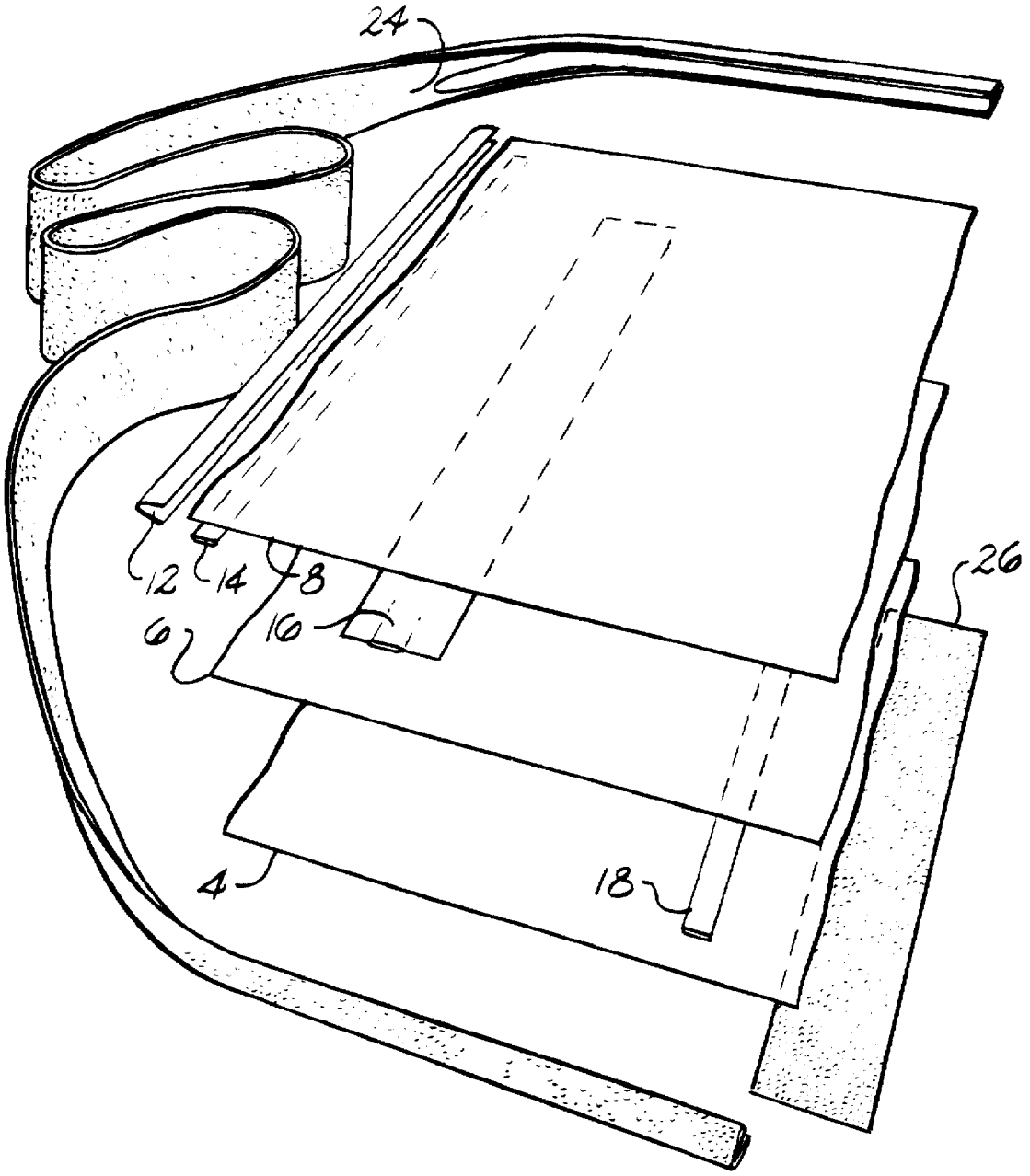
FIG. 1 is an exploded perspective view of a preferred embodiment of the present invention.
Figure 2:
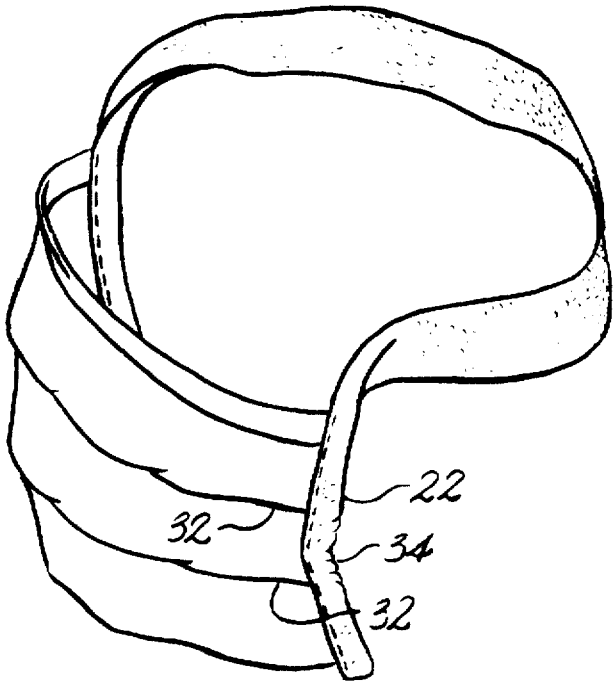
FIG. 2 is a side view of a preferred embodiment of the present invention.
Figure 8:
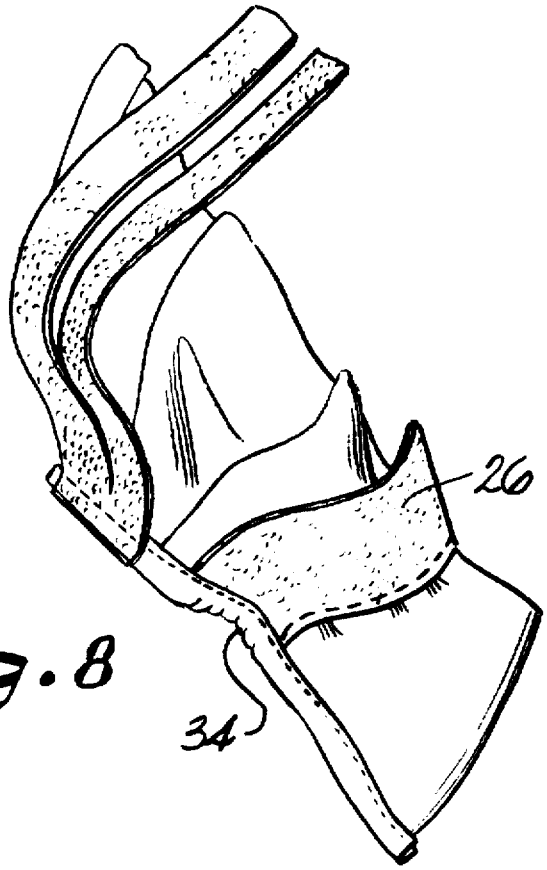
FIG. 8 is a perspective view of a portion of a mask showing select features of an alternative embodiment of the invention.

As seen in FIG. 1, an embodiment of a bacteria filtering mask 1 includes a flexible porous filtering section 2 comprising a plurality of distinct rectangular layers. A head strap 24 is carried by the upper corners of the mask while the lower edge of the mask is folded to provide a pouch 30 for engaging the chin of a wearer. As seen in FIG. 2, edges 22, including the folded sides of the pouch, are sealed with the terminal ends of the strap 24 material. Alternatively, as seen in FIG. 8, the side edges 22 may be sealed with a separate length of binding.

Filter section 2 comprises an outer layer 4 of a non-woven spun-bonded material, at least one intermediate layer 6 of a non-woven meltblown material, and a non-woven inner layer 8 of a cellulose or combined cellulose and synthetic fiber material.

If desired, outer layer 4 may be chemically treated to provide a liquid barrier layer for enhanced safety and efficiency of the mask. Layer 8 should have good moisture absorbing properties to increase the comfort and durability of the mask.

As seen in reference to FIG. 2, one of the preferred embodiments of the mask provides a series of folded pleats 32 defined by filter section 2. The pleats allow a donned mask to expand to cover the wearer's face. However, an enormous variety of pad constructions and components can be provided.

As best seen in reference to FIGS. 2–4 and 7, all edges of filter section 2 have a seam or other sealed margin. In the preferred embodiments, an upper-edge 10 is enclosed by binding strip 12 which may be sewn, glued, sonically welded or sealed using a combination of heat and pressure. Upper-edge 10 further defines a first support stay 14 which runs the width of mask 1. Stay 14 provides an adjustable nose-piece support for mask 1 and may be provided by a thin strip of a deformable material such as a strip of aluminum, thin gauge steel, or a plastic bendable strip. Preferably, stay 14 is either carried by an inner surface of binding strip 12 or between the filter section layers using an adhesive strip or other securing means.

Figure 4:
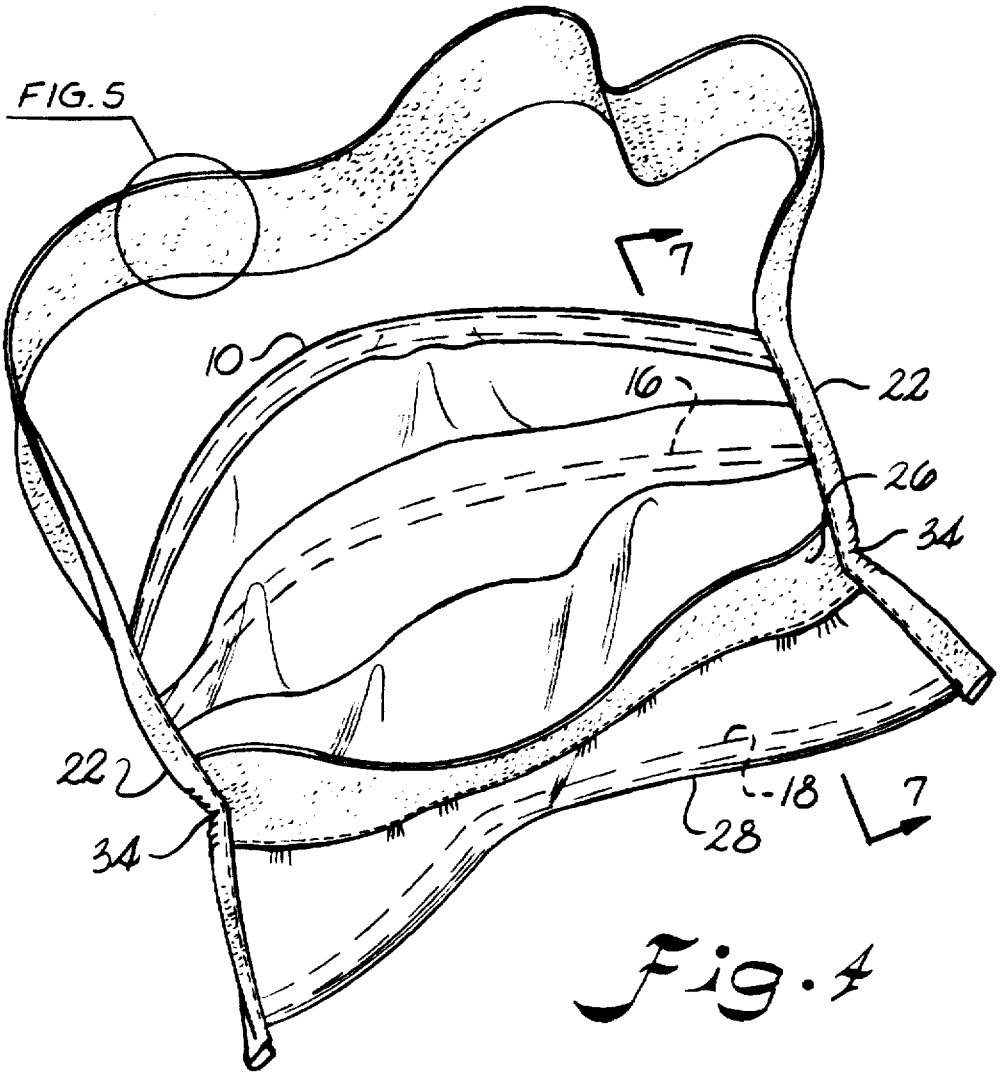
FIG. 4 is a rear view of the embodiment of the invention shown in FIG. 2.
Figure 5:
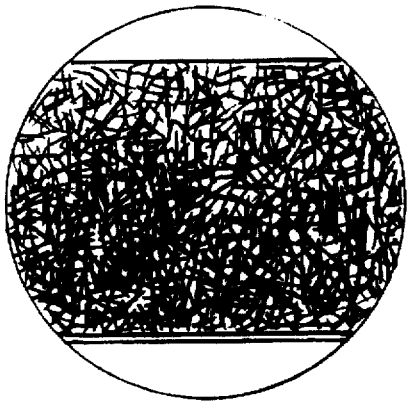
FIG. 5 is an enlargement of the headband material as indicated in FIG. 4.

Filter section 2 also carries a second stay 16 and a third stay 18. Stay 16 and 18 are similar in construction to stay 14 and are secured to one or more filter section layers and in a substantially parallel fashion relative to stay 14. The stays provide a three dimensional, cup-like mask configuration for improved breathing along with an improved, more comfortable fit. Stay 16 is positioned along the filter section so as to be substantially opposite the nose and mouth area of the wearer. Stay 18 is positioned along the bottom folded edge 28 of mask 1 (FIG. 4).

Headband 24 is preferably provided by a fiber-based (non-latex) elastomeric material, though conventional latex material may be used. Preferred elastomeric materials may include non-woven fabric such as stretch bonded laminate; spunbond fabric such as neck-bonded laminate; and woven or knitted stretch fabrics. Stretch bonded laminates are well-known in the art as exemplified in U.S. Pat. No. 4,720,415 to Vander Wielen et al. and U.S. Pat. No. 5,169,706 to Collier et al., both of these patents being incorporated by reference herein. Neck-bonded laminates are also known as discussed in U.S. Pat. No. 5,226,992 to Morman, this patent being incorporated herein by reference. A preferred elastomeric material is a composite material comprising a non-woven fibrous elastic web joined to a gatherable web. Such an elastomeric material is commercially available under the trademark Demique® (Kimberly-Clark Corporation).

Figure 3:
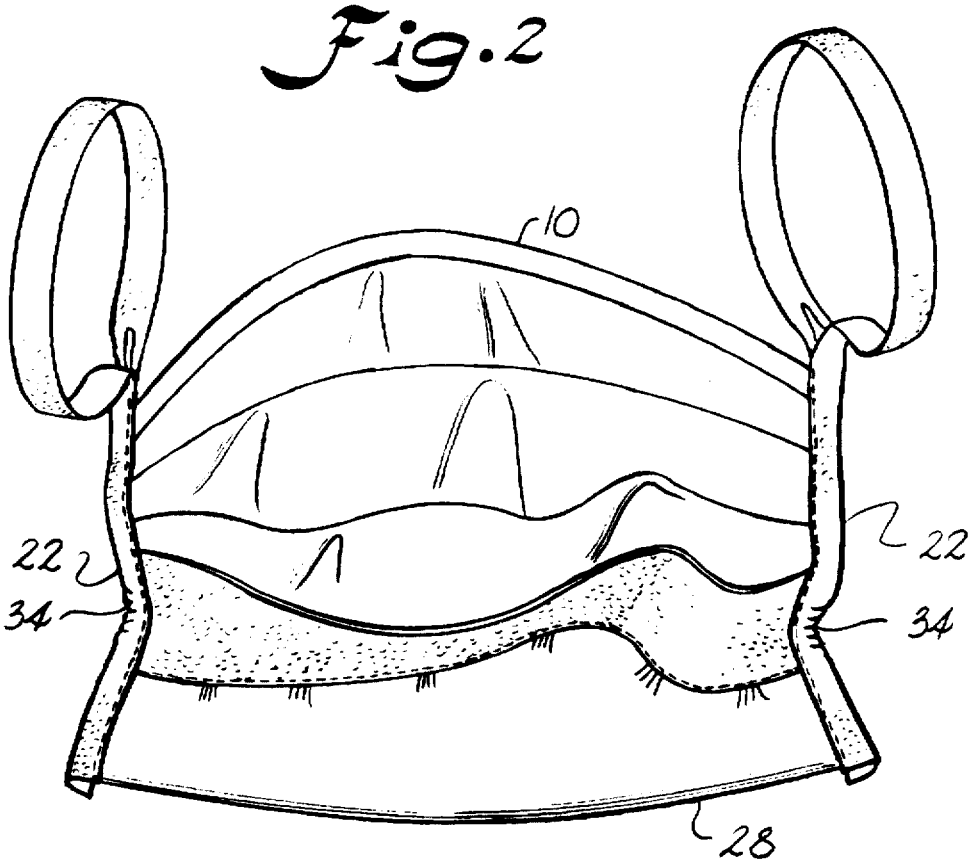
FIG. 3 is a rear view of an embodiment of the invention.

Alternatively, as seen in FIG. 3, ear loops may be provided in place of the headband. Each loop may be provided by either a latex or non-latex elastomeric material as taught above.

Each side of mask 1 further defines a sealed edge 22. Edges 22 are preferably sealed with a separate piece of material such as the elastomeric material used for the headband. It has been found useful to apply the edge binding under tension, i.e. the elastic material being stretched. The resulting tension facilitates the donning of mask and contributes to the face conforming features of the installed mask. As seen in reference to FIG. 2, one preferred embodiment of the present invention uses a continuation of the elastomeric headband material to provide a double sided binding for the sealed edge 22. An additional embodiment seen in FIG. 8 provides a separate piece of material for the headband and which is attached at the upper corners of the mask. As seen in FIG. 8, the headband may further define a central slit to improve the fit and comfort of the headband.

A similar elastomeric fabric is secured to the terminal edge of the folded portion of filter section 2 and provides a chin-strap 26 which passes under the chin of the wearer. Strap 26 helps form a gasket or seal around the wearer's face. The resulting fold and chin-strap further provides a pouch 30 for engaging the wearer's chin. As best seen in FIG. 8, where strap 26 is attached to edge 22, the attachment sites form slight gathers 34 so that both the side seams bow in slightly. The gathers are formed by applying the strap 26 to the edges and body of the mask while strap 26 is stretched or under tension. Once attached, the tension from strap 26 helps maintain the donned mask in its desired cup-like configuration.

The formation of the side two gathers, under tension, along the side seams help further define pouch 30 and improves the sealing ability of the mask along the edge of the wearer's face. Similar gathers 41 where strap 26 is secured to the body of the mask also defines pouch 30 and contributes to the effective, face-conforming shape and seal of the installed mask.

The elastomeric headband, chin strap, side gathers, and the tensioned construction offers several advantages. One, the headband enables a universal fit. Specifically, one mask size will adjust to fit a wide range of different wearer's sizes and dimensions and offers an improved fit and comfort for individuals with beards. The mask dispenses with the need for tie strings and may be removed or repositioned without the delay and nuisance of untying and retying tie straps. Unlike a traditional mask, the present invention provides an automatic self-adjusting fit as a result of the stretch properties of the elastomeric materials. The mask components and their assembly provide a mask having mechanical and stretch properties which facilitate the proper donning and wearing of the mask. As a result, the efficacy of the present mask is superior to prior art masks.

Additionally, the headband and chin strap is comfortable to wear for extended periods of time and can be economically supplied in a variety of widths. The use of preferred fiber-based non-latex elastomeric material provides a latex-free mask which is a preference of many health care providers.

The combination of the elastic head strap and chin strap discourages improper use of a mask. Often, the wearer of a traditional tie mask will untie the upper ties and leave the used mask to hang about the wearer's neck. Such use is a breach of health and safety regulations, yet remains a common occurrence. The present invention's design and construction is such that removal of the head strap will result in the complete removal of the mask as well. Consequently, the mask design promotes compliance with health and safety regulations.

The fibrous elastomeric material allows perspiration and moisture to pass through, increasing the wearer's comfort. Bulk packaging of the present mask is facilitated in that there are no loose ties to become entangled with adjacent masks.

The central portion of stay 16, opposite the wearer's nose, can be bowed outwardly in an arcuate fashion to provide a generally concave pocket opposite the wearer's nose and mouth. Stay 14 is used to contour the upper mask edge along the nose and face of the wearer while stay 18 is used to adjust the bottom edge 30 of the mask in conformity to the wearer's jaw-line. The stays enable the mask to assume an improved, three dimensional shape which increases the breathing area of the mask and maintains a well defined breathing area for the donned mask such that the wearer may breathe and talk normally without interference with the inner mask surface. The ability to individually shape the mask to the wearer's face allows a tighter, more efficient seal and compensates for variations among individuals.

Figure 6:
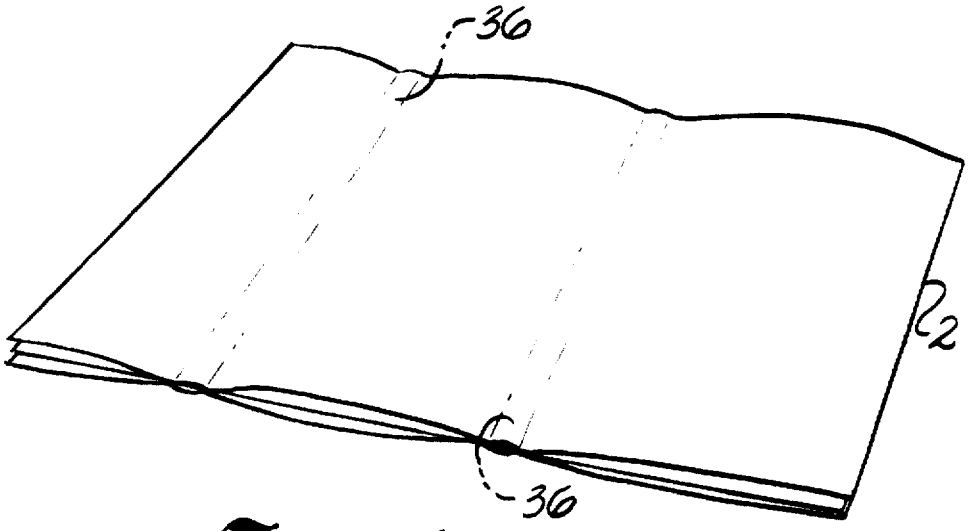
FIG. 6 is an enlarged view of a portion of the filter pad in which the filtering layers have been heat sealed at selected points along the width of the filter pads.
Figure 7:
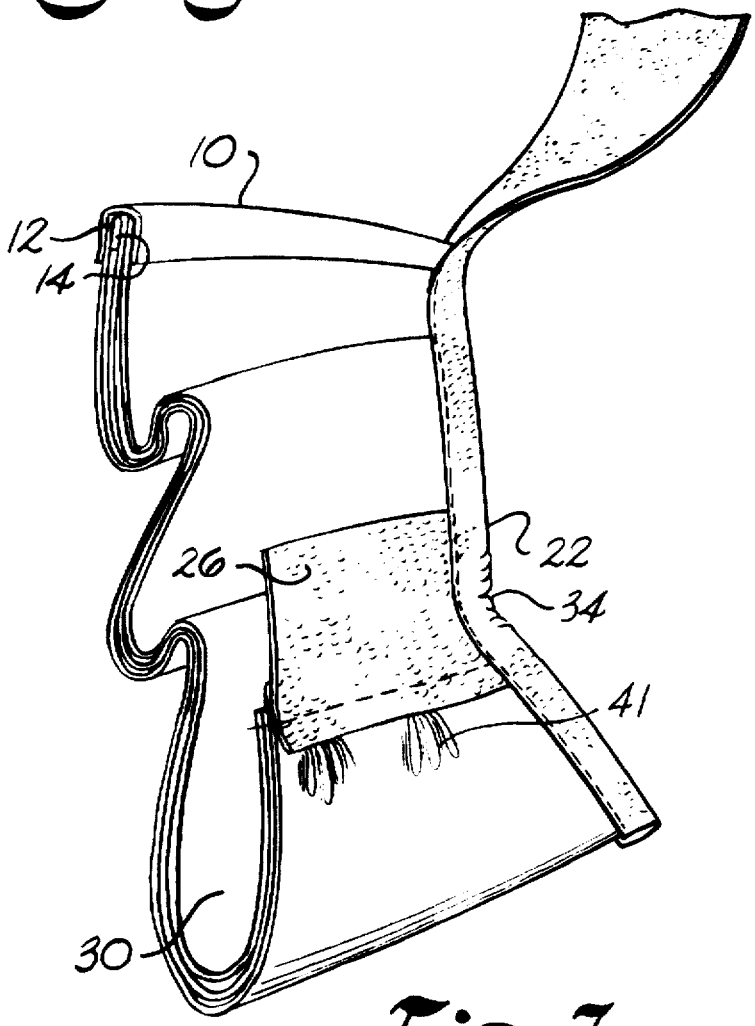
FIG. 7 is a sectional view taken along line 7—7 as seen in FIG. 4.

As seen in FIG. 6, a portion of the filter section 2 can be melted or sonically welded to form a plurality of supports 36. Each individual support 36 provides structural rigidity for the adjacent regions of the filter section 2. Providing one or more supports parallel to stay 16 increases the rigidity of the cup-like portion formed by the mask. It is envisioned that stay 16 may be eliminated entirely and replaced by one or more supports 36.

Supports 36 may be formed by using heated rollers, applied under pressure, to melt the thermoplastic layers into one integral structure. While the supports 36 are illustrated as substantially horizontal to the mask's stays and pleats, it is envisioned that the supports may be of varying size, width, design and direction and may even be used to imprint a logo or ornamental design to the mask.

The supports do not compromise the efficacy of the mask since the melted, unitary supports maintain the barrier properties, firmly bonds to non-melting adjacent filter layers of the mask, and have only a negligible effect on the available surface area for air exchange.

Figure 9:
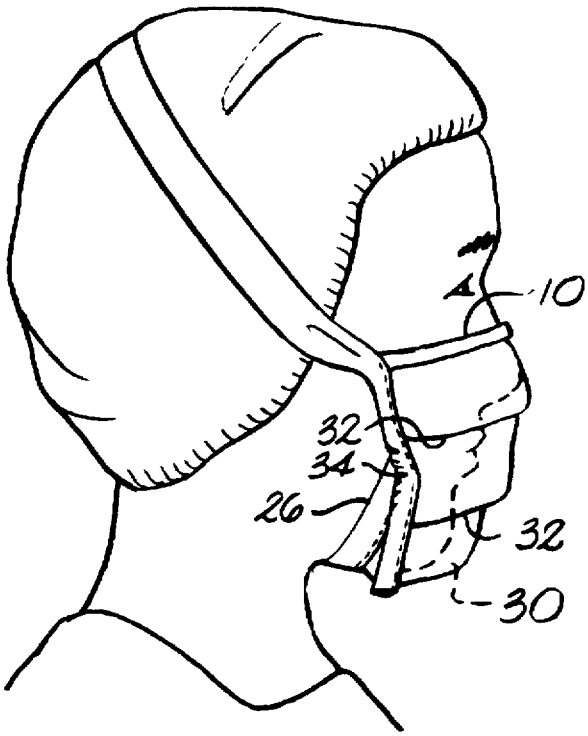
FIG. 9 is a side view of the preferred embodiment of the present invention as worn.

Traditionally, surgical-type masks tend to flex as the wearer inhales and exhales, causing material fatigue which allows the mask to collapse against the mouth and nose. This, in turn, makes the mask uncomfortable to wear for extended periods, hinders the wearer's ability to speak, and saturates the mouth/nose portions of the mask, compromising mask function or efficiency. The structural support provided by the stays of the present mask maintains a defined space between the mask and the wearer's nose/mouth. The defined space is best seen in reference to FIG. 9. The structural supports and stays are not seen in this view to better illustrate the breathing area of the donned mask.

In addition, the present invention provides an improvement over rigid, 3-dimensional masks as such masks are not adjustable to an individual wearer's face. Accordingly, to maintain a sufficiently tight seal, rigid, pre-formed masks often use a tighter engaging force to pull the mask tightly to the face. Accordingly, such a mask is uncomfortable to wear for prolonged periods and suffers from a drawback that a generic shaped 3-dimensional mask may not provide a comfortable or an intimate, effective seal for all individuals.

While the mask can be supplied in a substantially flat, rectangular shape, an armature or similar template may be used during manufacturing to engage each mask and partially preform each mask into a cup-like, more compact configuration. Shaping the mask during manufacturing enables the mask to be more easily stacked in a nested configuration and permits storage in a tubular sleeve or similar housing for easier dispensing. Dispensing from a nested configuration is facilitated by the fact that loose draw-strings are eliminated from the mask.

While the comfort and effective fit of the present mask is ideally suited for the healthcare industry, the novel features of the present mask are also suitable for other industries. For instance, manufacturing jobs which require a "clean room" environment would benefit from the present mask design. Likewise, the present mask design is compatible with applications for filtering out dust and other nuisance particles in a variety of manufacturing, custodial, and household applications.

The above description is given in reference to specific examples of an adjustable face mask. However, it is understood that many variations are apparent to one of ordinary skill in the art from a reading of the above specification and such variations are within the spirit and scope of the present invention as defined by the following appended claims.

That which is claimed:

1. A flexible face mask comprising:

a generally rectangular filtration pad having an inner layer and an outer layer, said pad having a top edge, a bottom edge, and a pair of opposing side edges, said bottom edge being folded to define a pouch between opposing portions of said inner layer;

securing means for retaining the mask on the head of a wearer;

a first deformable stay integral with said upper sealed edge;

a second deformable stay secured along said bottom fold;

a third deformable stay secured by said pad a spaced distance from said first stay so as to be opposite the nose and mouth of a wearer when said mask is donned;

an elastomeric strip carried under tension by a terminal flap of a pocket and being in further tensioned communication at either terminus of said strip with a corresponding mid-point of a side edge of said pad;

wherein when said masked is donned, said plurality of stays are adjustable by the wearer to position a periphery of said mask in close conformity to the wearer's face, while further defining a cup-like chamber opposite the nose and mouth of the wearer.

2. The mask according to claim 1 wherein said securing means further defines an elastomeric headband.

3. The mask according to claim 2 wherein said headband further defines a slit through a central portion of said headband.

4. The mask according to claim 1 wherein said securing means further defines a first ear loop and a second ear loop.

5. The mask according to claim 1 wherein said stays are substantially the same length as a width of said pad.

6. The mask according to claim 1 wherein said pad further comprises a support provided by a melted band of filter pad material.

7. The mask according to claim 1 wherein said pad further defines a plurality of pleats.

8. A flexible face mask comprising:

a multi-layer filter having an upper edge, two side edges, and a lower edge defined by a fold of overlapping inner filter surfaces which further defines an inner pouch;

a horizontal pleat defined by said filter;

a first stay carried by said upper edge;

a second stay carried by said folded edge;

a support comprising a melted unitary strip of said filter material, said strip defined between said first stay and said second stay; and, an elastomeric strap carried by a side edge for securing said mask to the head of an individual.

9. A flexible face mask comprising:

a substantially rectangular, multi-layered filter medium having a pocket engaging a wearer's chin, said pocket defined by a lower fold of said medium;

a first adjustable stay carried by an upper edge of said filter media;

a second adjustable stay carried by a base of said pocket;

a support comprising a melted unitary band of filter medium, said support provided between the first stay and the second stay; and means for securing said filter media opposite a wearer's nose and mouth.

10. The mask according to claim 9 wherein said medium further defines a horizontal pleat.

11. The mask according to claim 9 wherein opposing edges of said mask are adjustable to shape said mask to conform to an individual user's face.

12. The mask according to claim 9 wherein said securing means further defines an elastomeric chin strap, said strap applied under tension to an upper edge of said pocket, respective terminal ends of said strap further engaging respective sides of said mask and forming a gather at each said side.

13. The mask according to claim 12 wherein a first edge and a second edge of said mask each further define a gather, each said gather formed by the attachment of a terminal end of said strap while under tension to said respective edges.

14. The mask according to claim 8 wherein said securing means further defines an elastomeric headband secured to an edge of said mask and an elastomeric chin strap, said strap applied under tension to an upper edge of said pocket, respective terminal ends of said strap further engaging respective sides of said mask and forming a gather at each said side.

15. The face mask according to claim 1 wherein said elastomeric strip has an upper edge and a lower edge, the lower edge of said strap attached to said terminal flap of said pocket.

16. The mask according to claim 1 wherein said elastomeric strip carried under tension under by said terminal flap further defines an upper edge which extends above said terminal flap of said pocket.

17. The mask according to claim 8 wherein a terminal flap of said inner pouch carries an elastomeric strip having an upper edge and a lower edge, the lower edge of said strip attached to said terminal flap.

18. The mask according to claim 8 wherein a terminal flap of said inner pouch carries an elastomeric strip, said strip having an upper edge which extends above said terminal flap of said pouch.

* * * * *